US009464855B2

(12) United States Patent
Nilsson

(10) Patent No.: US 9,464,855 B2
(45) Date of Patent: Oct. 11, 2016

(54) COUNTERMASS CONTAINER FOR USE IN A RECOILLESS WEAPON AND A RECOILLESS WEAPON COMPRISING SUCH A COUNTERMASS CONTAINER

(75) Inventor: Mats Nilsson, Skattkärr (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 14/378,443

(22) PCT Filed: Feb. 13, 2012

(86) PCT No.: PCT/SE2012/000017
§ 371 (c)(1),
(2), (4) Date: Nov. 20, 2014

(87) PCT Pub. No.: WO2013/122514
PCT Pub. Date: Aug. 22, 2013

(65) Prior Publication Data

US 2015/0059566 A1 Mar. 5, 2015

(51) Int. Cl.
*F41A 1/10* (2006.01)
*F41F 3/042* (2006.01)

(52) U.S. Cl.
CPC *F41A 1/10* (2013.01); *F41F 3/042* (2013.01)

(58) Field of Classification Search
CPC ..... F41A 1/08; F41A 1/10; F42B 5/05
USPC ..... 89/1.7, 1.701, 1.702, 1.703, 1.704, 89/1.705, 1.706
See application file for complete search history.

(56) References Cited

U.S. PATENT DOCUMENTS 3,216,323 A 11/1965 Wengenroth et al.
4,574,680 A 3/1986 Nicodemus
4,759,430 A * 7/1988 Kalin ..... F16F 7/123 188/271

(Continued)

FOREIGN PATENT DOCUMENTS

DE 3730158 * 12/1990
EP 0100722 A 2/1984

(Continued)

OTHER PUBLICATIONS

PCT/ISA/210—International Search Report—Sep. 5, 2012 (Issued in PCT/SE2012/000017).

(Continued)

*Primary Examiner* — Stephen M Johnson
(74) *Attorney, Agent, or Firm* — Venable LLP; Eric J. Franklin

(57) ABSTRACT

A countermass container for use in a recoilless weapon. The countermass container includes an envelope encloses a countermass. A recoilless weapon includes a barrel accommodating an ammunition unit, a propellant charge and a countermass container. The countermass container includes an envelope enclosing a countermass. The barrel includes a front end opening for firing the ammunition unit out of the barrel and a rear end opening for ejecting the envelope and countermass of the counter mass container. The envelope is divided into a front section and a rear section. The rear section of the envelope has a weaker construction than the front section of the envelope to more easily crack than the front section of the envelope. Splines are provided at the front section to create ducts.

19 Claims, 3 Drawing Sheets

(56) References Cited

U.S. PATENT DOCUMENTS

| | | | | |
|---|---|---|---|---|
| 5,551,330 | A | 9/1996 | Reuche | |
| 6,286,408 | B1 * | 9/2001 | Sanford | F41A 25/06 89/1.7 |
| 8,707,847 | B2 * | 4/2014 | Wang | F41A 1/10 89/1.701 |
| 2005/0217468 | A1 | 10/2005 | Ax et al. | |
| 2005/0235816 | A1 | 10/2005 | Franzen et al. | |
| 2006/0249011 | A1 | 11/2006 | Ax et al. | |
| 2007/0068374 | A1 * | 3/2007 | Ostberg | F41A 1/10 89/1.701 |
| 2010/0282054 | A1 | 11/2010 | Ax et al. | |

FOREIGN PATENT DOCUMENTS

| | | | |
|---|---|---|---|
| FR | 1374423 | A | 10/1964 |
| GB | 2 129 105 | A | 5/1984 |
| WO | WO-91/11673 | | 8/1991 |

OTHER PUBLICATIONS

PCT/ISA/237—Written Opinon of the International Searching Authority—Sep. 5, 2012 (Issued in PCT/SE2012/000017).

PCT/IPEA/409—International Prelimianry Report on Patentability—Jan. 9, 2014 (Issued in PCT/SE2012/000017).

* cited by examiner

COUNTERMASS CONTAINER FOR USE IN A RECOILLESS WEAPON AND A RECOILLESS WEAPON COMPRISING SUCH A COUNTERMASS CONTAINER

CROSS-REFERENCE TO RELATED APPLICATIONS

This application is the national phase under 35 U.S.C. §371 of PCT/SE2012/000017 filed 13 Feb. 2012.

TECHNICAL FIELD

The present invention relates to a countermass container for use in a recoilless weapon comprising an envelope enclosing a countermass. The invention also refers to a recoilless weapon comprising a barrel accommodating an ammunition unit such as a projectile or shell, a propellant charge and a countermass container comprising an envelope enclosing a countermass, the barrel comprising a front end opening for firing the ammunition unit out of the barrel and a rear end opening for ejecting the comprised envelope and countermass of the countermass container.

BACKGROUND

In order to compensate for the recoil that occurs when shells, projectiles or similar ammunition units are fired from a weapon such as an anti-tank weapon, anti-armour weapon or similar weapon held by a weapon user such as a soldier, an impulse opposing the recoil of the ammunition is needed. If no opposite directed impulse is created, high recoils may occur rendering the weapon unusable to the weapon user for security reasons. Today there are two common ways to create this opposing impulse.

One way of doing this is to arrange a conical nozzle in the rear end of the weapon that ventilates a large amount of gun powder gas and creates a counter force. An example of such a weapon on the market is our recoilless rifle Carl Gustaf. The principle to create the counter force is the same as for a rocket motor.

Another way of doing this is to use a countermass that accelerates backwards in the weapon barrel when the ammunition unit is fired forwards under gas pressure created by gun powder exploding between the ammunition unit and the countermass. In comparison with the nozzle arrangement a smaller amount of gun powder is required for corresponding projectile muzzle velocities. The principle using countermass is today used in our anti-tank weapon AT4 CS and many similar weapon systems worldwide. Examples of recoilless weapon using the countermass principle and embodiments of countermass containers are inter alia known from US 2005217468 A1, US 2006249011 A1, U.S. Pat. No. 6,286,408 B1, US 2005235816 A1 and WO 91/11673 A1.

When using recoilless weapons based on the countermass principle it is likely that symmetry problems occur affecting the hit rate. The symmetry problems may inter alias result in that the countermass is obliquely ejected, that an asymmetrical gas leakage arises around the countermass, and that pressure differences are obtained in the weapon funnel during the firing phase. When comparing the nozzle principle with the countermass principle, it is also normally so that the countermass principle does not present the same repeatability in recoil and hit rate as conventional ammunition based on technique using nozzle and expansion of gas.

SUMMARY OF THE INVENTION

The main object of the invention is to obtain a countermass container and a recoilless weapon avoiding the problems discussed above and in particular the symmetry problems.

The object is obtained by a countermass container according to the first paragraph and a recoilless weapon according to the first paragraph characterized in that the envelope is divided into a front section and a rear section, the rear section of the envelope having a weaker construction than the front section of the envelope to more easily crack than the front section of the envelope. This solution offers acceptable recoil levels, increased repeatability and reduced sideway disturbances in the weapon and due to that an essentially increased hit rate.

In order to further improve the operation of the weapon the countermass container according to an advantageous embodiment is characterized in that the front section of the envelope is provided with splines to create ducts between the front end of the front section and the front end of the rear section.

Preferably the splines are arranged around the front section in a longitudinal direction and preferably evenly distributed around the front section.

According to another advantageous embodiment the splines are designed as longitudinal alternately recesses and raisings around the periphery of the front section of the envelope. The proposed recess and raising design offers large opportunities to adapt the countermass container to prevailing circumstances. For example the widths of the recesses and raisings can be varied. It is also possible to mix different widths of the recesses and/or raisings. The design can also be unsymmetrical to meet for example sideway disturbances.

Furthermore, according to still another favourable embodiment the front section of the envelope can be designed in one piece with an envelope surface and a front surface. Making the front section of the envelope in one piece is cost effective and facilitates the mounting together of the countermass container.

In order to obtain a rear section of envelope having a weaker construction than the front section of envelope, it is according to yet another embodiment proposed that the front section of the envelope is made of a rigid plastic material and that the rear section of the envelope is made of a closed-cell cross-linked polyethylene foam.

As a suitable contermass it is proposed to use a formable countermass of solid material such as steel grit. Examples of other solid materials are plastic balls and aluminium grit. Another alternative is to use a liquid such as water.

According to an advantageous embodiment of the recoilless weapon a cylindrical sleeve is disposed at the rear end of the barrel close to the rear end opening and adapted to fill out a space formed between the countermass container and the barrel, the sleeve being provided with splines to create ducts between the front end of the front section of the countermass container and the front end of the rear section of the countermass container. By introducing the possibility to provide the sleeve with splines, ducts between the front end of the front section and the front end of the rear section are obtained and still more variations in design are available. This offers possibilities to provide ducts either in the sleeve or in the front section of the container or both in the sleeve and in the front section of the container.

BRIEF DESCRIPTION OF THE DRAWINGS

The invention will now be described in more detail with reference to the accompanying drawings in which.

DETAILED DESCRIPTION

Figure 1:
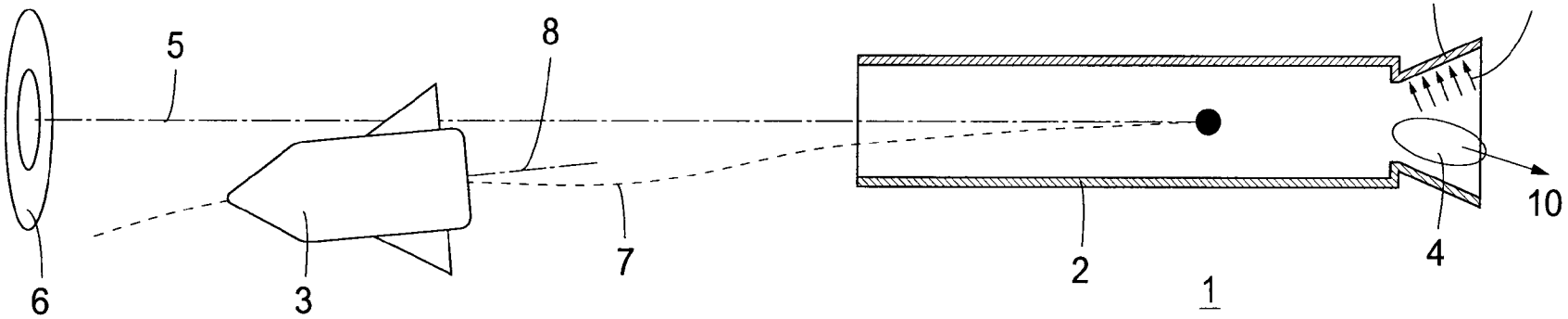
FIG. 1 schematically illustrates disturbances that may occur when an ammunition unit such as a shell or projectile is fired from a known countermass weapon towards a target.

FIG. 1 illustrates the firing of an ammunition unit from a conventional known recoilless weapon 1 based upon the countermass principle. In the figure the initially in the barrel 2 of the recoilless countermass weapon 1 located ammunition unit 3 has just been fired from the barrel by action of a not shown propellant charge acting on the ammunition unit 3 and a countermass 4 in opposite directions. A dash dotted line indicates the ideal path 5 for the ammunition unit to reach the target 6. Due to different firing disturbances and ammunition unit oscillation the ammunition unit 3 follows a path 7 indicated as a dashed line. The symmetry axis of the ammunition unit has been given reference number 8 and is indicated by a dash dotted line. The reasons for the deviation from the ideal path 5 are many and are often more accentuated for sub calibre countermass solutions. The following reasons for the deviation from the ideal path 5 can be noted:

The countermass is obliquely expelled.

There is unsymmetrical gas leakage around the counter mass.

A pressure difference occurs in a funnel 9 at the rear end of the barrel 2 tending to turn the weapon during the firing phase.

The angular velocity of the weapon in azimuth and elevation initiates ammunition unit oscillation influencing hit rate, track time and effect in the target.

In FIG. 1 the countermass 4 is located in an unsymmetrical position in the funnel 9 and an arrow 10 indicates the direction of movement. It is also illustrated by arrows 11 that there is a pressure difference in the funnel 9 tending to turn the weapon. To meet the deviations described, a symmetrical spreading out of the countermass 4 is highly desired and how this is obtained is described below with references to FIGS. 2-6.

Figure 2:
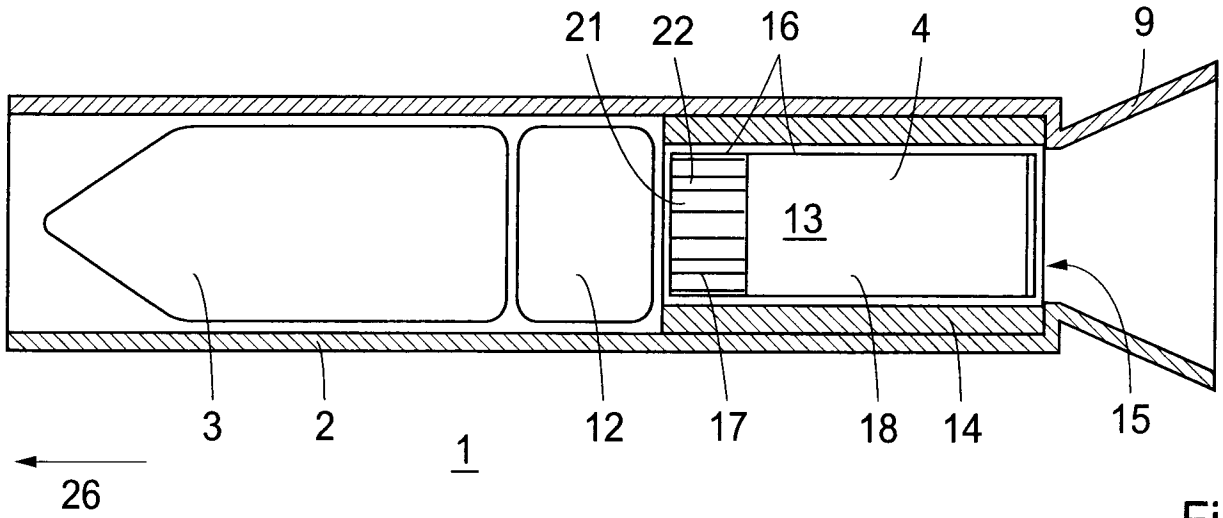
FIG. 2 shows an example of a recoilless weapon according to the invention provided with a countermass container according to the invention.

The recoilless weapon 1 shown in FIG. 2 comprises a barrel 2, an ammunition unit 3 such as a shell or projectile, a propellant charge 12, a countermass container 13 surrounded by a sleeve 14, and a funnel 9. The countermass container 13 comprises a countermass 4 of a liquid such as water or a solid material such as steel grit. In the shown case the countermass container 13 is dimensioned as a sub calibre countermass container dimensioned to pass a rear opening 15 of lesser diameter than the barrel diameter.

In principle the operation of the weapon is as follows. When the weapon user fires the weapon, the propellant charge expels the ammunition unit 3 in the shooting direction 26 while the countermass container 13 with content is ejected opposite in the backward direction. If the ammunition unit and countermass container are adequately balanced no essential recoil arises.

Figure 4A:
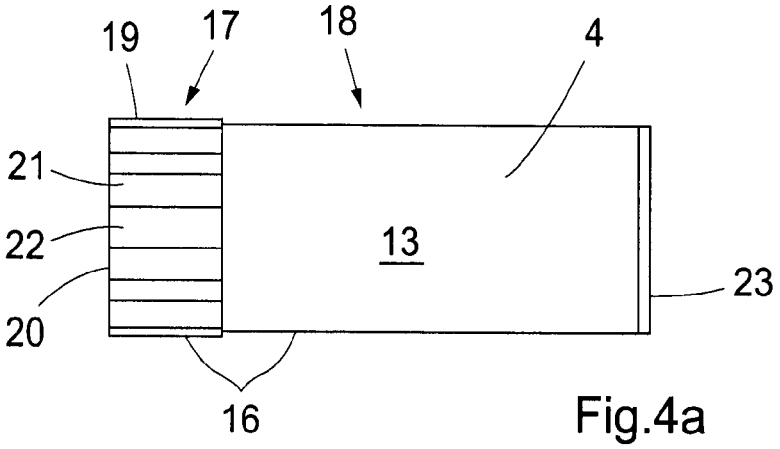
FIG. 4*a* shows a longitudinal side view of a countermass container according to the invention.
Figure 4B:
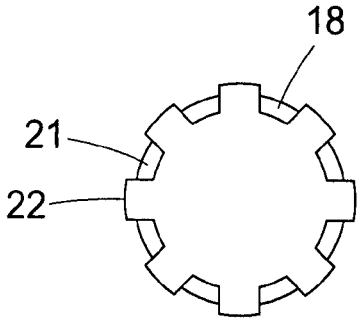
FIG. 4*b* shows a front view of the countermass container shown in FIG. 4*a*.
Figure 5:
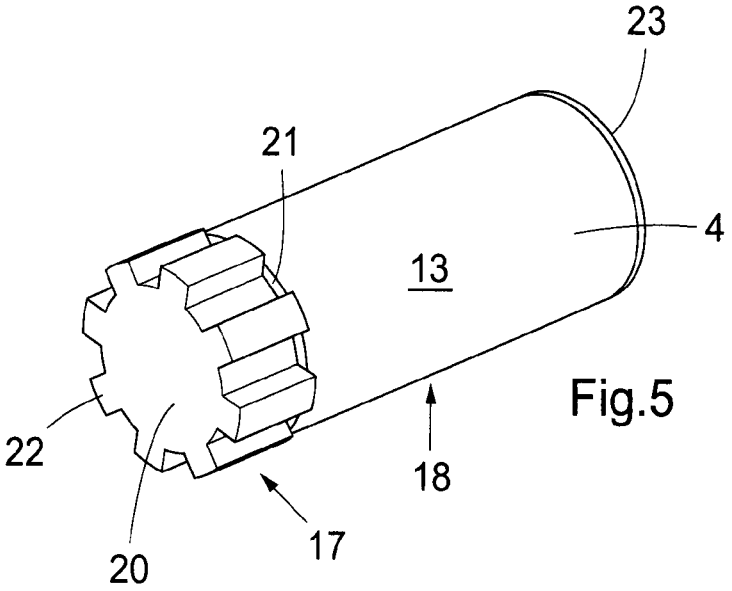
FIG. 5 shows a perspective view of the countermass container shown in FIGS. 4*a* and 4*b* seen obliquely from the front.

An example of a countermass container 13 used in a recoilless weapon according to the invention is now described with reference to FIGS. 4*a* and 4*b* and FIG. 5. The countermass container 13 has an envelope 16 divided into a front section 17 and a rear section 18 that together accommodates the countermass 10.

Figure 6A:
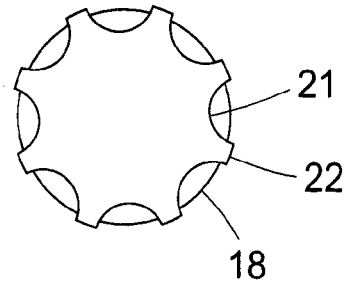
FIG. 6*a*-6*b* show further examples in front view of embodiments of countermass containers according to the invention.
Figure 6B:
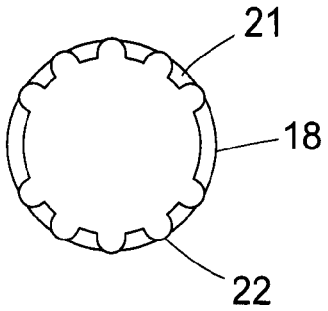

The front section 17 preferably has less extension than the rear section and usually less than a third of the total extension of the countermass envelope 16. The front section is made of a material and dimensioned such that it has a stronger construction than the rear section 18. Examples of suitable materials is plastic materials and a combination of rigidity and dimensioning are parameters that can be used to obtain desired stability and strength. The front section 17 shown is made in one piece and comprises an envelope surface 19 and a front surface 20. The front surface is preferably even while the envelope surface is provided with longitudinal recesses 21 and raisings 22 to obtain ducts between the front end of the front section and the front end of the rear section. These recesses 21 and raisings 22 can be evenly distributed around the envelope surface as shown in FIGS. 3*a* and 3*b*. However, the shown embodiment does not exclude an uneven distribution. The sizes and shapes of the raisings and recesses are also possible to vary within a wide range. Some examples of sizes and shapes of raisings and recesses are shown in FIGS. 6*a*-6*b*. Essential is that ducts are created between the front end of the front section 17 and the front section of the rear section 16. It is also possible to dimension the recesses and raisings such that backwards widening or narrowing of the ducts are obtained.

The rear section 18 of the envelope normally covers the main part of the countermass and has a weaker construction than the front section of the envelope. A suitable material is a foam material such as polyethylene foam. Preferably the foam material is a closed-cell cross-linked foam. In the rear end of the rear section 18 the contermass container can be provided with a bottom plate 23.

Figure 3:
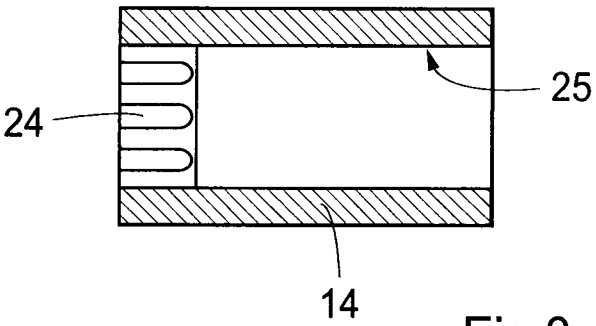
FIG. 3 shows an example of a modified detail of the recoilless weapon shown in FIG. 2.

Instead of providing the front section of the envelope with recesses and raisings to create ducts, it is according to FIG. 3 proposed to provide the sleeve 14 in the recoilless weapon as described with reference to FIG. 2 with longitudinal ducts 24 in the inner surface 25 adjacent to the front section of the envelope. In FIG. 3 such a sleeve 14 is shown separately.

In FIG. 6*a* to FIG. 6*b* two different examples of embodiments of raisings 22 an recesses 21 are shown.

According to FIG. 6*a* the recesses 21 are shaped as rounded cavities. Furthermore the recesses 21 have a wider extension than the raisings 22. FIG. 6*b* illustrates that the recesses 21 and raisings 22 can be unevenly distributed around the front section 17 of the envelope.

The invention is not limited to the examples described above but may be modified within the scope of the attached claims.

The invention claimed is:

1. A countermass container for use in a recoilless weapon, the countermass container comprising:

an envelope enclosing a countermass, the envelope being divided into a front section and a rear section, the rear section of the envelope having a weaker construction than the front section of the envelope to more easily crack than the front section of the envelope, wherein the front section of the envelope comprises splines to create ducts between the front end of the front section and the front end of the rear section.

2. The countermass container according to claim 1, wherein the splines are arranged around the front section in a longitudinal direction.

3. The countermass according to claim 2, wherein the splines are evenly distributed around the front section.

4. The countermass container according to claim 1, wherein the front section of the envelope is made of a rigid plastic material.

5. The countermass container according to claim 1, wherein the rear section of the envelope is made of a closed-cell cross-linked polyethylene foam.

6. The countermass container according to claim 1, wherein the countermass is a liquid.

7. The countermass container according to claim 6, wherein the countermass is water.

8. The countermass container according to claim 1, wherein the countermass is a formable solid material.

9. The countermass container according to claim 8, wherein the countermass is steel grit.

10. A countermass container for use in a recoilless weapon, the countermass container comprising:

an envelope enclosing a countermass, the envelope being divided into a front section and a rear section, the rear section of the envelope having a weaker construction than the front section of the envelope to more easily crack than the front section of the envelope, wherein the front section of the envelope comprises splines to create ducts that are evenly or unevenly distributed between a front end of the front section and a front end of the rear section.

11. A countermass container for use in a recoilless weapon, the countermass container comprising:

an envelope enclosing a countermass, the envelope being divided into a front section and a rear section, the rear section of the envelope having a weaker construction than the front section of the envelope to more easily crack than the front section of the envelope, and a sleeve surrounding the countermass container, wherein an inner surface of the sleeve comprises longitudinal ducts adjacent the front section of the envelope.

12. A recoilless weapon, comprising:

a barrel accommodating an ammunition unit, a propellant charge, and a countermass container comprising an envelope enclosing a countermass, the barrel comprising a front end opening for firing the ammunition unit out of the barrel and a rear end opening for ejecting the comprised envelope and countermass of the countermass container, the envelope enclosing the countermass being divided into a front section and a rear section, the rear section of the envelope having a weaker construction than the front section of the envelope to more easily crack than the front section of the envelope, wherein a cylindrical sleeve is disposed at the rear end of the barrel close to the rear end opening and adapted to fill out a space formed between the countermass container and the barrel, wherein splines are provided at the front section of the envelope to create ducts between the front end of the front section and the a front end of the rear section.

13. The recoilless weapon according to claim 12, wherein the sleeve comprises splines to create ducts between the front end of the front section of the countermass container and the front end of the rear section of the countermass container.

14. The recoilless weapon according to claim 13, wherein the splines are arranged around the front section in a longitudinal direction.

15. The recoilless weapon according to claim 14, wherein the splines are evenly distributed around the front section.

16. The recoilless weapon according to claim 13, wherein the splines are designed as longitudinal alternately recesses and raisings around the periphery of the front section of the envelope.

17. The recoilless weapon according to claim 12, wherein the front section of the envelope is designed in one piece with an envelope surface and a front surface.

18. The recoilless weapon according to claim 12, wherein the front section of the envelope is made of a rigid plastic material.

19. The recoilless weapon according to claim 12, wherein the rear section of the envelope is made of a closed-cell cross-linked polyethylene foam.

* * * * *